United States Patent [19]

Anstett Edgar P.

[11] Patent Number: 4,657,166

[45] Date of Patent: Apr. 14, 1987

[54] PNEUMATICALLY OPERATED NAILING MACHINE

[76] Inventor: Anstett Edgar P., 21 Lakewood Pl., Highland Park, Ill. 60035

[21] Appl. No.: 802,840

[22] Filed: Nov. 29, 1985

[51] Int. Cl.[4] ..... B25C 1/04

[52] U.S. Cl. ..... 227/7; 227/139; 227/130

[58] Field of Search ..... 227/130, 139, 131, 7, 227/8

[56] References Cited

U.S. PATENT DOCUMENTS

| | | | |
|---|---|---|---|
| 3,208,353 | 9/1965 | Wandel | 227/130 X |
| 3,607,300 | 8/1971 | Anstett | 227/130 X |
| 4,380,312 | 4/1983 | Landrus | 227/139 X |
| 4,470,531 | 9/1984 | Anstett | 227/139 X |

*Primary Examiner*—Paul A. Bell

*Attorney, Agent, or Firm*—Wallenstein, Wagner, Hattis, Strampel & Aubel, Ltd.

[57] ABSTRACT

A pneumatically operated nailing machine having a reciprocatable blade for driving nails when advanced, and a reciprocatable differential piston unit connected to the blade. The reciprocatable differential piston unit has an upper, small diameter piston and a lower, large diameter piston interconnected by a piston rod. The upper, small diameter piston has valve means for venting any air under pressure therebelow to atmosphere when the blade is advanced by the reciprocatable differential piston. Nail guide and positioning means are provided for the machine for maintaining each nail of a nailing strip in proper alignment with the blade and a workpiece when the blade is advanced. Nail feeder means is provided for the machine for maintaining the nails of a nailing strip in proper alignment as they are sequentially advanced into the nail guide and positioning means.

16 Claims, 35 Drawing Figures

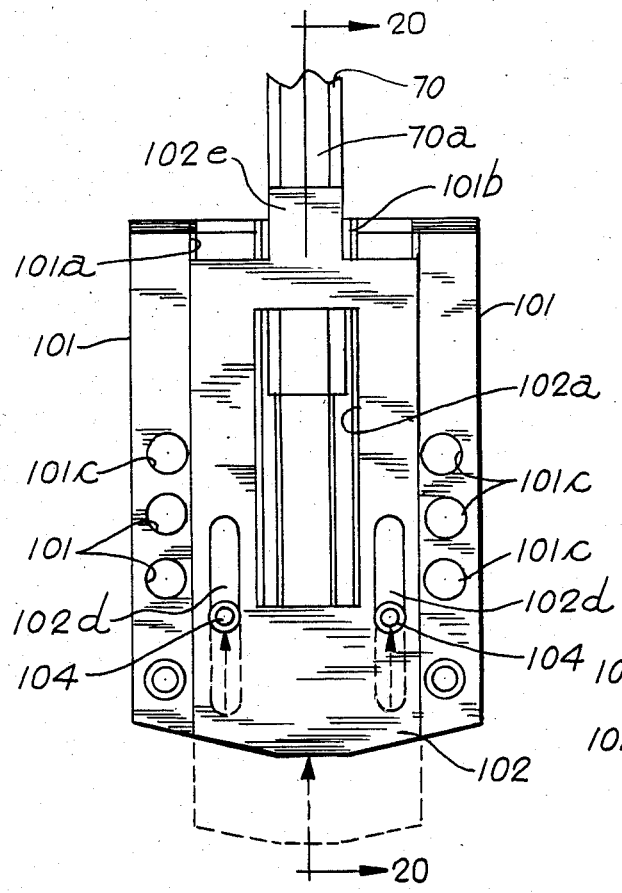
FIG. 19
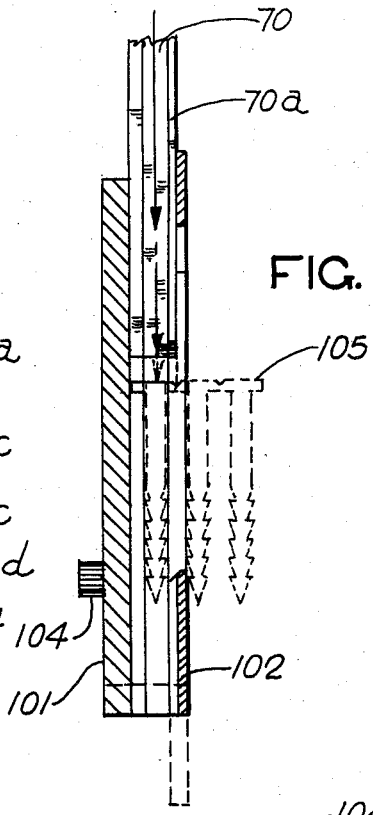
FIG. 20
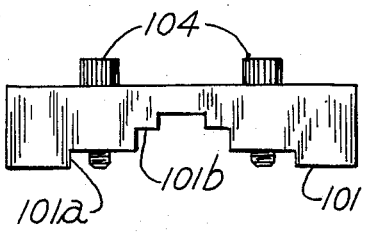
FIG. 24
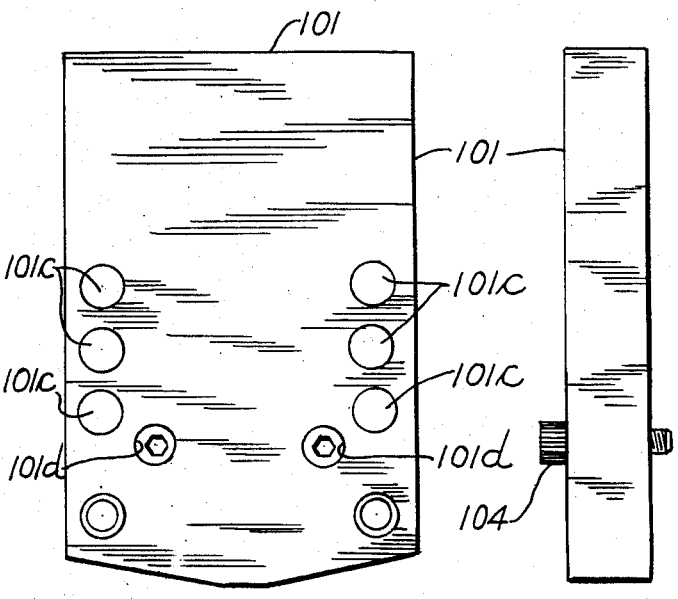
FIG. 23
FIG. 22
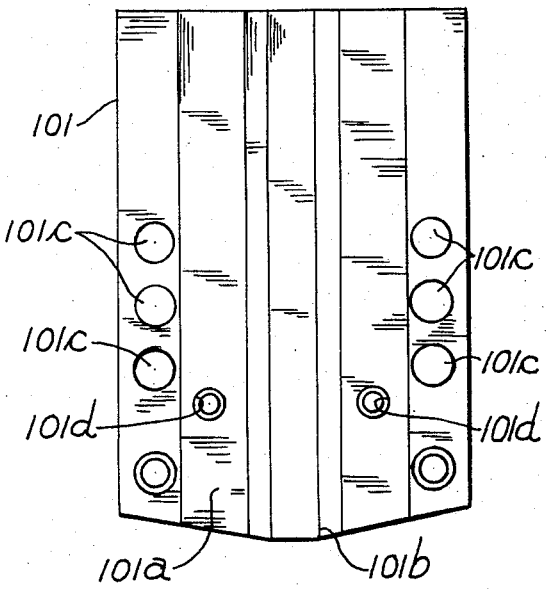
FIG. 21

102
102b
102e
102b
102
102e
102
102e
102"
102e
102'
101e
102a
102a"
102a'
102d
102c
27

PNEUMATICALLY OPERATED NAILING MACHINE

FIELD OF THE INVENTION

The present invention is directed to a pneumatically operated nailing machine which includes a reciprocatable blade for driving nails into a workpiece, and a reciprocatable differential piston for advancing and retracting the blade.

BACKGROUND OF THE PRIOR ART

In U.S. Pat. No. 3,601,300, dated Aug. 24, 1971, there is disclosed a pneumatically operated nailing machine. The machine includes a hollow housing which is supplied with air under pressure. A reciprocatable blade extends through the bottom of the housing for sequentially driving nails into a workpiece. A reciprocatable differential piston unit is located in the housing. The piston has a lower, large diameter piston and an upper, small diameter piston connected by a piston rod. Means is provided for securing the reciprocatable nail driving blade to the lower end of the differential piston unit so as to advance and retract the blade as the differential piston unit is reciprocated. A cylinder sleeve is reciprocatably mounted in the housing and it has a cylinder reciprocatingly receiving the lower, large diameter piston of the differential piston unit. A cylinder member is located in the housing and it has a cylinder reciprocatingly receiving the upper, small diameter piston of the differential piston unit. The cylinder member includes passageways for venting to atmosphere an upwardly facing annular valve seat carried thereby and the cylinder thereof above the upper, small diameter piston of the differential piston unit. The housing has passageways for venting to atmosphere the cylinder of the cylinder sleeve below the lower, large diameter piston of the differential piston unit. The cylinder member also has passageways for continuously supplying air under pressure from the hollow housing to the cylinder thereof below the upper, small diameter piston of the differential piston unit. The machine of the patent further includes control valve means, which in one condition, supplies air under pressure from the housing below the cylinder sleeve for moving the cylinder sleeve upwardly to a position whereby the cylinder of the cylinder sleeve above the lower, large diameter piston of the differential piston unit is sealed from air under pressure in the housing and is vented to atmosphere. The control valve means is also operative, when in another condition, for venting to atmosphere air from below the cylinder sleeve for allowing air under pressure in the housing to move the cylinder sleeve downwardly. This causes the air under pressure in the cylinder of the cylinder sleeve above the large diameter piston of the differential unit to overcome the force of the air under pressure in the cylinder member below the upper, small diameter piston of the differential piston unit and to move the same downwardly to advance the nail driving blade.

The control valve means of the patented machine includes a first valve having a normal position and movable to a second position when the nailing machine is placed against an object into which a nail is to be driven, and a second valve having a normal position and movable to a second position when a control trigger is manually depressed. The arrangement is such that air from below the cylinder sleeve is vented to atmosphere to move the cylinder sleeve downwardly and advance the nail driving blade only when both valves are moved to their second positions.

The housing of the machine disclosed in U.S. Pat. No. 3,601,300 has a foot plate secured thereto below the cylinder sleeve and the lower, large diameter piston of the differential piston unit through which the reciprocatable nail driving blade extends. A stationary nail guide plate and blade guide plate are secured to the foot plate for guiding the reciprocatable nail driving blade and a nail to be driven thereby. The blade guide plate has a pair of channels for slidably receiving a pair of pins which, when placed against a workpiece, acts to unseat the first valve of the control valve means. A magazine is also secured to the foot plate for feeding nails to the nail guide plate. The upper end of the reciprocatable nail driving blade of the machine disclosed in said patent is T-shaped, and a special two-part separable holder is employed to secure the blade to the lower end of the differential piston unit.

The machine of the U.S. Pat. No. 3,601,300 is adapted for use with nails of one size, and while guide means is provided for the nail as it is severed and then driven into a workpiece by the blade, the nails, in certain instances, will not always enter the workpiece at the proper angle, and, as a result, another nail will have to be used. These occurrences are due, in the main, to the nail feeder device of the patented machine, and to the lack of adequate support for the nails by the nail guide means at the point of severance by the nail driving blade. In addition, while the nailing machine of the patent provides excellent nailing force with a minimum amount of compressed air, the amount of compressed air used, and, concomitantly, the amount of force generated thereby is determined by the size of the nail which can be used in the machine. A larger sized nail, of course, would require a greater force to properly embed it in a workpiece. Since the patented machine is limited to use with nails of one size, the generation of a sufficient force to accommodate nails of various sizes is not a consideration in the construction of the patented machine.

BRIEF DESCRIPTION OF THE INVENTION

In accordance with the present invention, an improved pneumatically operated nailing machine has been evolved having unique versatility not only from the standpoint of its ability to accommodate nails of different length, but, also, from the standpoint of its ability to provide positive and unerring alignment of each nail in a nailing strip with the nail driving blade of the machine and a workpiece. The machine, moreover, has sufficient power to easily and rapidly drive nails of different length into a workpiece. What is more, this added power is attained with essentially the same amount of compressed air as is required to drive a nail with the machine of U.S. Pat. No. 3,601,300. The machine of this invention is simple in construction and rugged and foolproof in operation. It can be manufactured inexpensively, and quickly assembled with minimal labor.

The nailing machine of the present invention includes nail guide and positioning means which are interchangeable. The guide and positioning means advantageously comprises a movable member which in its extended, first position provides an opening or gate for receiving a nail of a preselected length, and which in its retracted, second position maintains the nail in proper alignment with the nail driving blade of the machine and a workpiece. The movable member, when placed against a workpiece, also acts to unseat the first valve of the control valve means of the machine thereby eliminating the need for pins such as are used in the nailing machine of U.S. Pat. No. 3,601,300. The nailing machine has nail feeder means for continuously urging the nails comprising a nailing strip into the opening or gate formed by the movable member of the guide and positioning means. The nail feeder acts to keep uniform pressure on areas of a nailing strip which tends to prevent bending or distortion of the shanks of the nails comprising the strip thereby cooperating with the movable member of the guide and positioning means to maintain the nails in proper alignment as they are successively and for the operator to remove the movable member of the guide and positioning means, and replace it with a movable member adapted for use with nails having the length required for a particular job. The removal and replacement of the movable member can be completed in a matter of seconds by simply removing fastening means provided on the machine.

The nailing machine, as indicated, has appreciably more power than the machine of U.S. Pat. No. 3,601,300 although it utilizes essentially the same amount of compressed air on each power stroke. More specifically in this connection, the upper, small diameter piston of the nailing machine of the present invention is provided with valve means connected to the upper end of the differential piston rod. As in the case of the nailing machine disclosed in U.S. Pat. No. 3,601,300, the nailing machine of this invention includes control valve means, which in one condition, supplies air under pressure from the housing below the cylinder sleeve for moving the cylinder sleeve upwardly to a position whereby the cylinder sleeve above the lower, large diameter piston of the differential piston unit is sealed from air under pressure in the housing and is vented to atmosphere. The control valve means of the present nailing machine, like the control valves of the nailing machine in said patent, is also operative, when in another condition, for venting to atmosphere air from below the cylinder sleeve for allowing air under pressure in the housing to move the cylinder sleeve downwardly. This causes the air under pressure in the cylinder of the cylinder sleeve above the lower, large diameter piston of the differential piston unit to overcome the force of the air under pressure in the cylinder member below the upper, small diameter piston of the differential piston unit and to move the same downwardly to advance the nail driving blade. By providing valve means for the upper, small diameter piston, at the instant the blade makes contact with the head of a nail to be driven into a workpiece, the valve means of the upper, small diameter piston of the present invention acts to release air under pressure below the small diameter piston to atmosphere thereby enabling the full force of the air under pressure above the lower, large diameter piston to be used to advance the nail driving blade. The greater driving force and more positive action thusly achieved, coupled with the ability of the nail guide and positioning means, and the nail feeder means, of the machine to always maintain each nail to be driven into a workpiece by the nail driving blade in proper alignment with the blade and the workpiece throughout the power stroke of the machine not only enhances the foolproof operation of the machine, but, also, appreciably reduces the amount of time required to complete a particular nailing job. A further added feature of the nailing machine of this invention is the simpler and more effective means employed to connect the nail driving blade to the reciprocatable mechanism of the machine.

The foregoing, and other advantages and features of the present invention will become apparent to those skilled in the art upon reference to the accompanying specification, claims and drawings.

BRIEF DESCRIPTION OF THE DRAWINGS

FIG. 19 is a rear view in elevation of an embodiment of the nail guide and positioning means of said embodiment of the machine;

FIG. 20 is a vertical sectional view taken substantially along line 20—20 of FIG. 19;

FIG. 21 is a rear view in elevation of the stationary plate member of the embodiment of the nail guide and positioning means shown in FIG. 19;

FIG. 22 is a side view of the plate member shown in FIG. 21;

FIG. 23 is a front view of the plate member shown in FIG. 21;

FIG. 24 is a top plan view of the plate member shown in FIG. 21;

DETAILED DESCRIPTION OF THE INVENTION

Figures 1, 2, 3, 4, 5, 6:
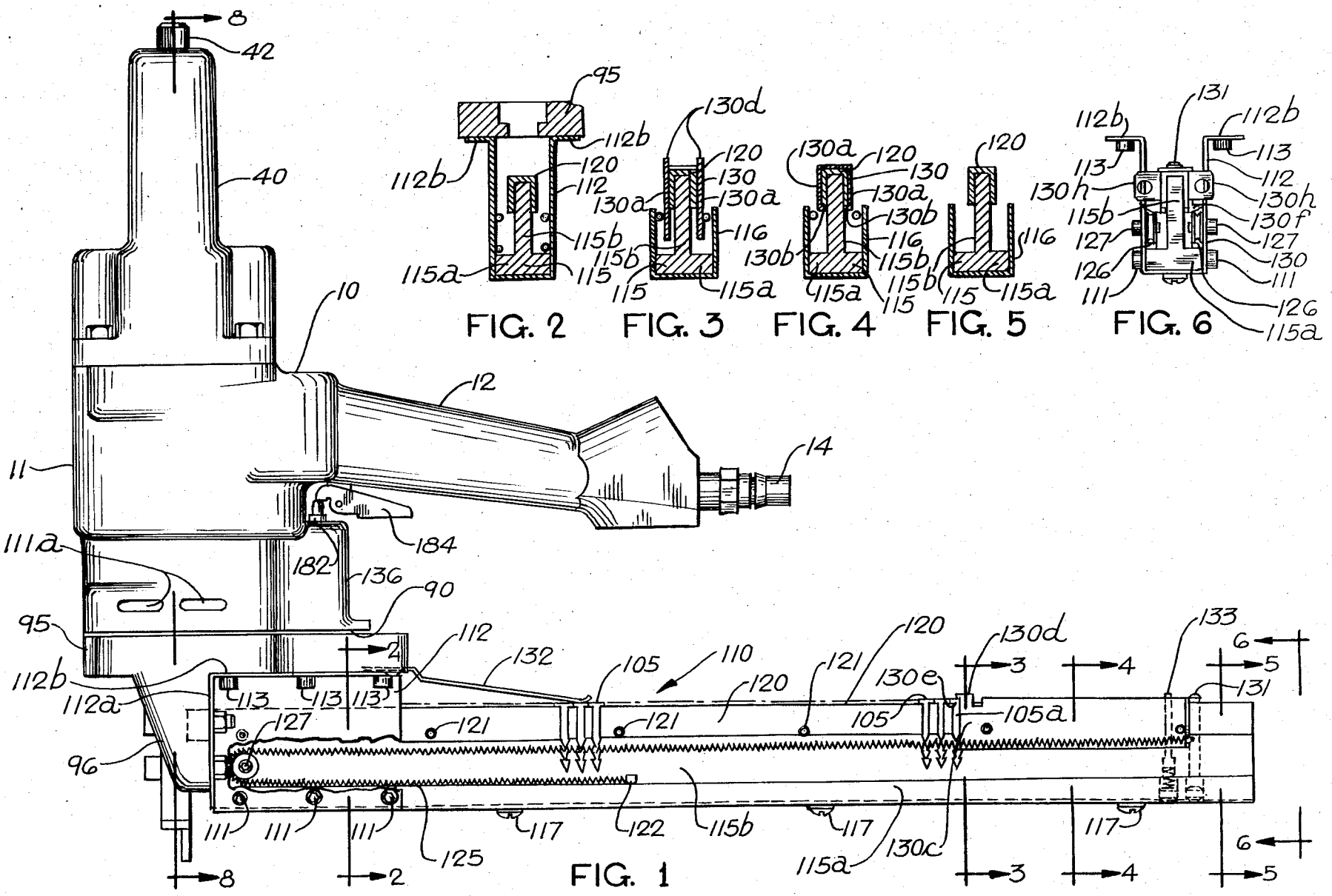
FIG. 1 is a side view in elevation of an embodiment of the nailing machine of the present invention with the magazine of the machine partly broken away to show details of the nail feeder mechanism of the machine.
FIG. 2 is a vertical sectional view taken substantially along line 2—2 of FIG. 1.
FIG. 3 is a vertical sectional view taken substantially along line 3—3 of FIG. 1.
FIG. 4 is a vertical sectional view taken substantially along line 4—4 if FIG. 1.
FIG. 5 is a vertical sectional view taken substantially along line 5—5 of FIG. 1.
FIG. 6 is a rear end view of the nail feeder mechanism of said embodiment of the machine as viewed along line 6—6 of FIG. 1.

As indicated hereinabove, the nailing machine of the present invention is an improvement over the nailing machine disclosed in U.S. Pat. No. 3,601,300. Therefore, to the extent that the improved nailing machine of this invention shares common elements with the nailing machine of said patent, those elements, and their function, are incorporated herein by reference.

Referring, now, to FIGS. 1, and 7 through 9 of the drawings, the embodiment of the nailing machine illustrated, and designated generally by reference numeral 10, includes a hollow housing 11 having a handle portion 12. The handle portion 12 has a cavity 13 to which air under pressure is supplied by a fitting 14. The upper portion of the hollow housing 11 has a cavity 15 which communicates with the cavity 13 of the handle portion 12, and is supplied with air under pressure from the cavity 13. The hollow housing 11 also has a cavity 16 which forms a cylinder portion for receiving a cylinder sleeve 17. The hollow housing 11 and its associated handle portion 12 is advantageously formed as a one-piece integral unit of any suitable lightweight material such as die cast aluminum, or the like.

Figure 33:
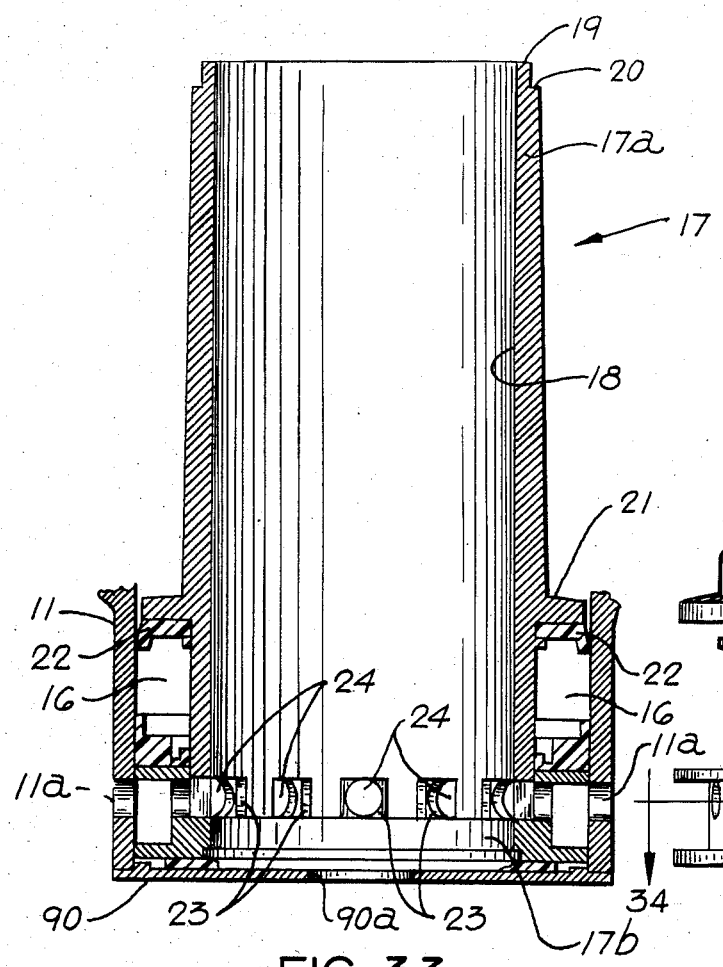
FIG. 33 is a vertical sectional view taken substantially along line 33—33 of FIG. 32.
Figure 32:
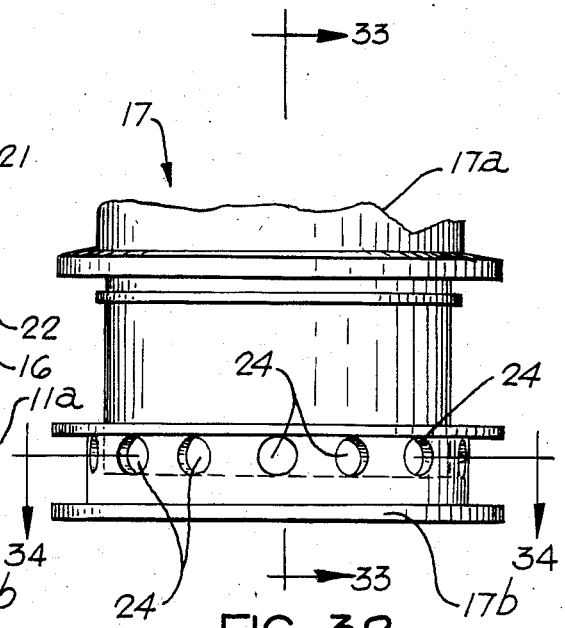
FIG. 32 is a fragmentary view in elevation of the reciprocatable cylinder sleeve of the nailing machine.
Figure 34:
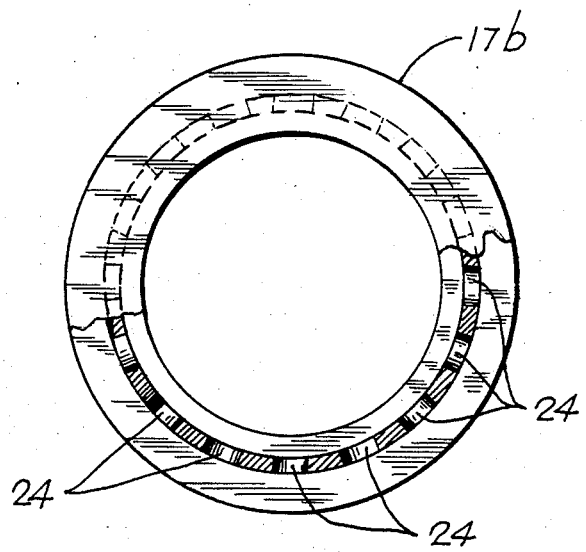
FIG. 34 is a partial sectional view taken substantially along line 34—34 of FIG. 32.

The cylinder sleeve 17 is reciprocatably received in the hollow housing 11 and has its lower portion slidably mounted in the cylinder portion defined by the cavity 16. As best shown in FIGS. 32 through 34, the cylinder sleeve 17 has an upper, slidable portion 17*a* and a lower, stationary portion 17*b*. The upper portion 17*a* of the cylinder sleeve 17 defines an internal cylinder 18 for the reciprocatable differential piston unit of the nailing machine. At its upper end, the upper portion 17*a* is provided with an upwardly facing annular valve seat 19 and an annular piston shoulder 20, the annular shoulder 20 being subject to air under pressure in the hollow housing 11. Intermediate its ends, the upper portion 17*a* of the cylinder sleeve 17 is provided with an annular piston flange 21 which, in turn, is provided with a packing 22. The annular piston flange 21 and its packing 22 operate in the cavity 16 of the hollow housing 11, the packing 22 forming an airtight seal between the cavity wall and the upper portion 17*a* of the cylinder sleeve 17.

The bottom edge or margin of the upper, slidable portion 17*a* of the cylinder sleeve 17 is formed with a plurality of circumferentially spaced spaces 23 which, when the portion 17*a* is in its down position, are in register with a plurality of circumferentially spaced openings 24 formed in the lower portion 17*b* of the cylinder sleeve 17. The openings 24 are in communication with a plurality of vents 11*a* (see FIG. 1) formed in the base of the housing 11 for venting to atmosphere air under pressure in the cylinder 18 defined by the slidable portion 17*a* of the cylinder sleeve 17.

The cavity 15 of the hollow housing 11 is sealed from the cavity 16 thereof by sealing means which includes a generally V-shaped resilient seal 25 secured to a backing ring 26. The backing ring 26 rests against a shoulder formed in the inner wall of the hollow housing 11, and, in addition to friction, it is also held in place by the air under pressure in the cavity 15. Thus, the upper side of the piston flange 17*a* is not affected by air under pressure in the cavity 15 of the hollow housing 11. The bottom of the cavity 16 of the hollow housing 11 is sealed by a packing 28 which is received in a suitable groove in the housing. The packing 28 also serves to seal the cylinder sleeve 17 with respect to the cavity 16.

Figure 9:
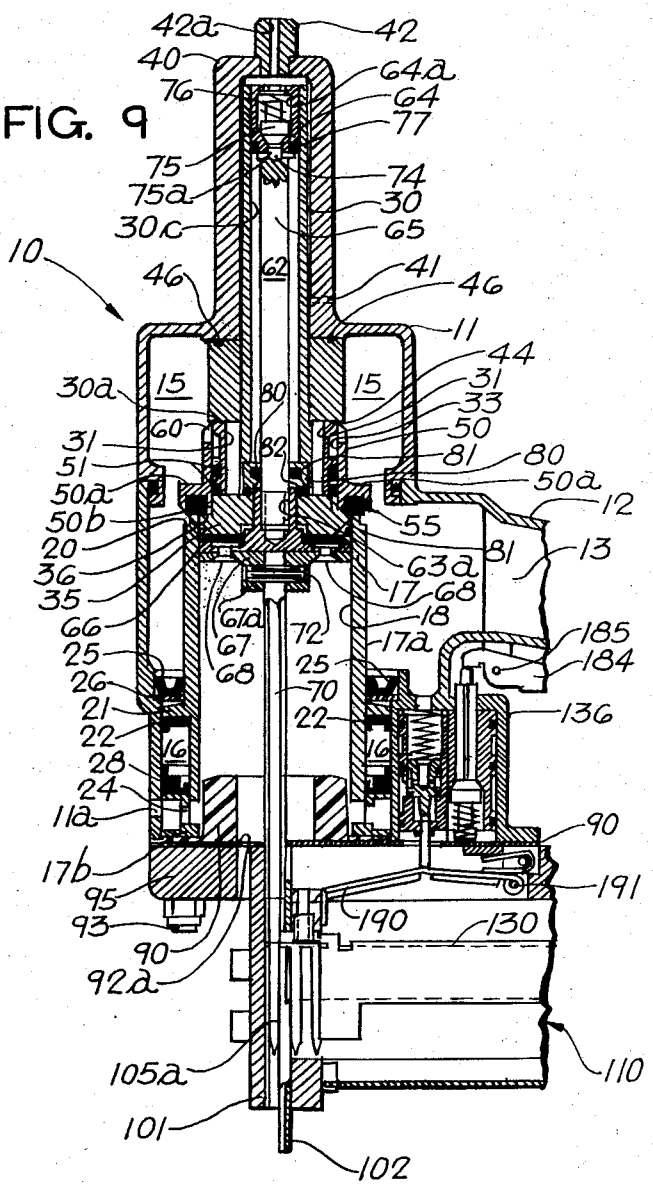
FIG. 9 is a vertical sectional view taken substantially alone line 9—9 of FIG. 7 illustrating the differential piston in its raised position.
Figure 8:
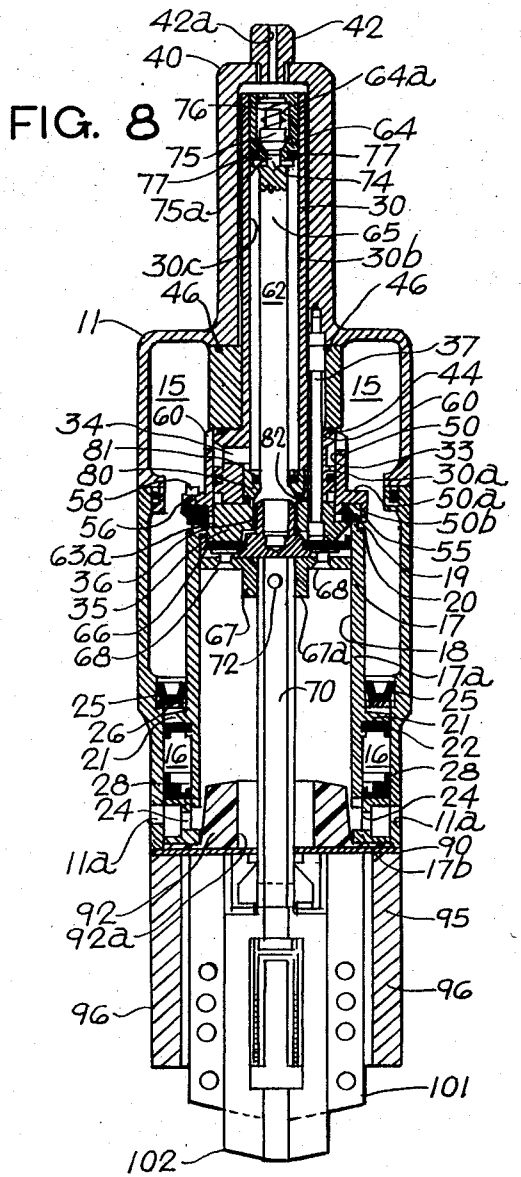
FIG. 8 is a vertically sectional view taken substantially along line 8—8 of FIG. 1.
Figure 7:
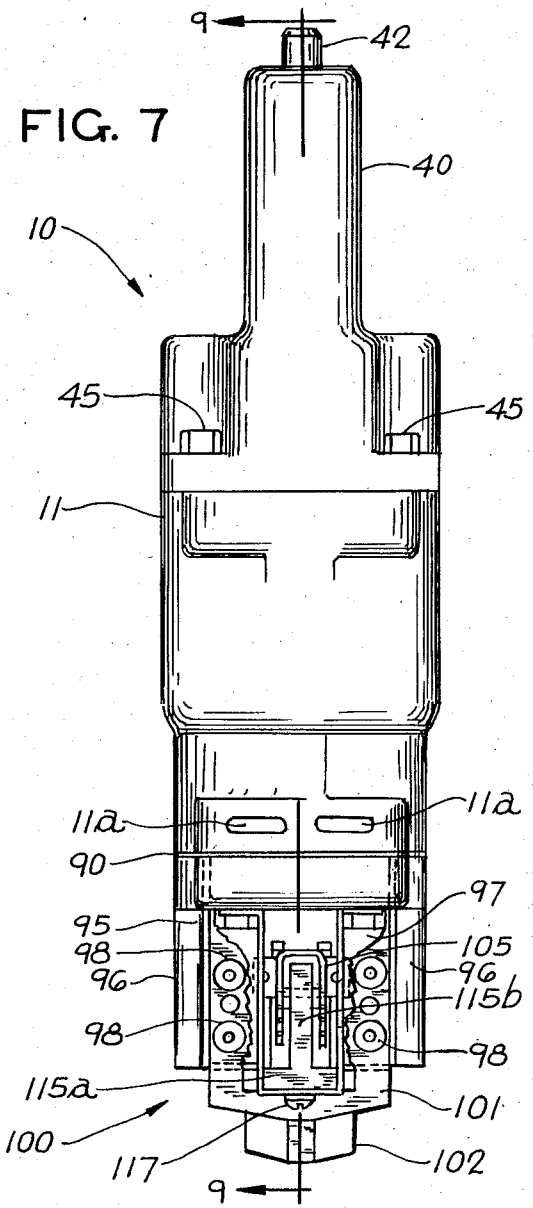
FIG. 7 is a end view in elevation of said embodiment of the machine with a portion of the nail guide and positioning means broken away.
Figure 12:
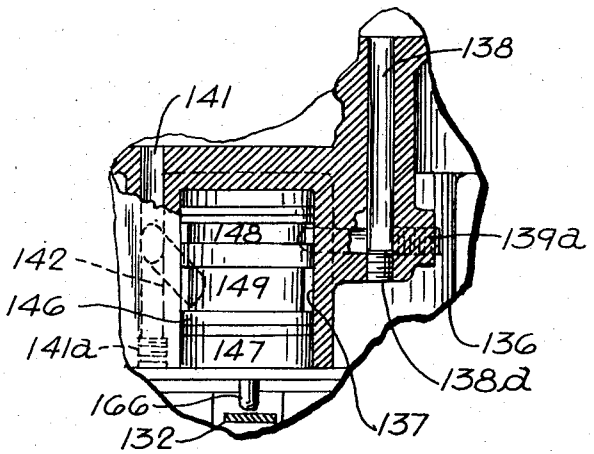
FIG. 12 is a vertical sectinal view taken substantially along line 12—12 of FIG. 11.
Figure 11:
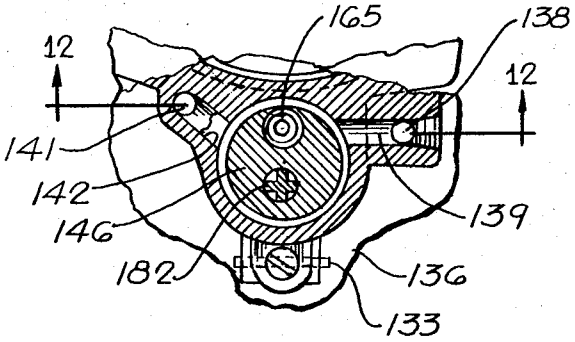
FIG. 11 is a horizontal sectional view taken substantially alone line 11—11 of FIG. 10.

As best shown in FIGS. 8, 9 and 20, the nailing machine 10, like the nailing machine of U.S. Pat. No. 3,601,300, is provided with a cylinder member 30 having a bottom portion 30*a* and a top portion 30*b*. The cylinder member 30 of the present invention differs from the cylinder member of the patent in that it is of one-piece, unitary construction. The top portion 30*b* of the cylinder member 30 has an internal cylinder 30*c*, and the bottom portion 30*a* has an internal shoulder 30*e*. The bottom portion 30*a* is provided with a plurality of vertically extending, circumferentially spaced, circular passageways 31 which communicate with radially extending, circumferentially spaced slots 32 formed in the base of the bottom portion 30*a*. Near its upper end the bottom portion 30*a* is provided with an annular groove 33 which is in communication with the internal cylinder 30*c* through a radial or transverse passageway 34. The cylinder member 30 advantageously is formed of a lightweight, high impact strength plastic material.

Engaging the base of the bottom portion 30*a* of the cylinder member 30 is a valve disc 35 having an upwardly facing, annular valve seat 36 which, as shown, is adjacent to and radially inwardly positioned from the upwardly facing annular valve seat 19 of the upper portion 17*a* of the cylinder sleeve 17. Screws 37, extending through holes in the valve disc 35 and through certain of the vertical passageways 31 in the bottom portion 30*a* of the cylinder member 30, are threaded into a cover 40 for securing the valve disc 35 and the cylinder member 30 to the cover 40. The cover 40 is provided with a transverse bore 41 which communicates the interior of the cover 40 with the atmosphere. A knurled headed screw 42, having a central bore 42*a* therethrough is threadedly engaged in bore 43 formed in the top of the cover 40. The bores 41 and 42*a* communicate with the passageways 31 and the slots 32 of the cylinder member 30 above the upwardly facing annular valve seat 36 of the valve disc 35. In this way, the valve seat 36 is vented to atmosphere. The upper end of the bottom portion 30*a* of the cylinder member 30 is provided with a seal ring 44 for sealing the same against the cover 40. The radial passageway 34 in the cylinder member 30 operates to supply air under pressure from the hollow housing 11 to the cylinder 30*c* in the cylinder member 30. The cover 40 is secured to the hollow housing 11 by means of screws 45—45, and an O-ring 46 forms a seal between the hollow housing 11 and the cover 40. The cover 40 desirably is formed of a lightweight metal such as aluminum, or and aluminum alloy, and the valve disc 35 may be formed of a suitable metal such as steel, or the like.

Figure 10:
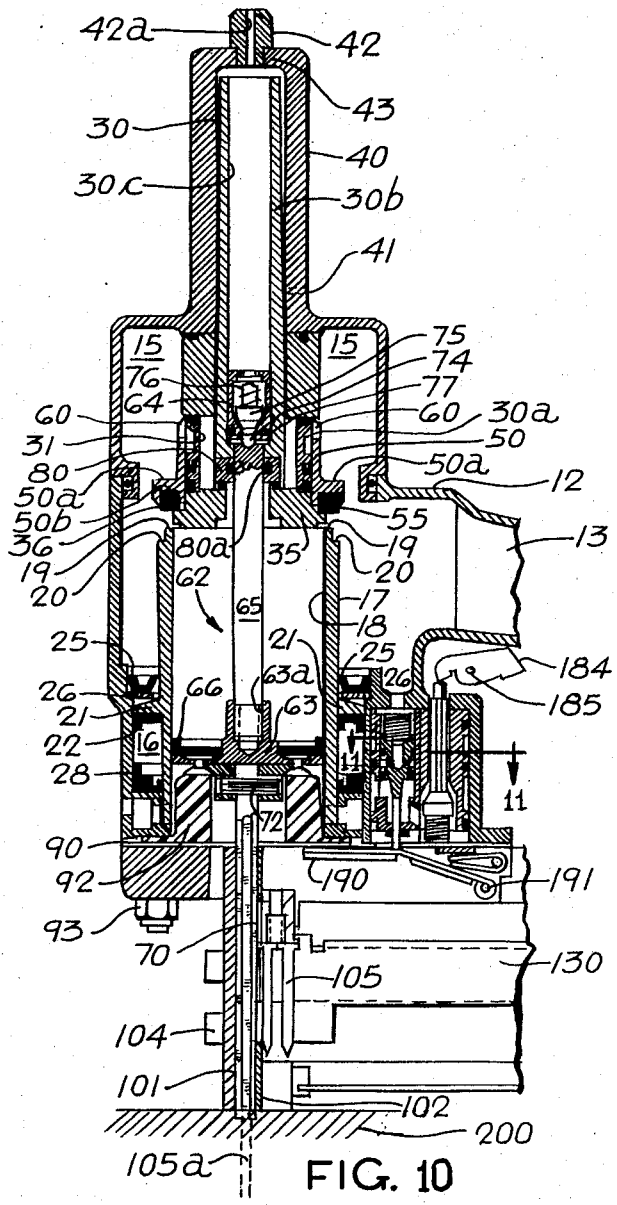
FIG. 10 is a view corresponding to the view of FIG. 9 illustrating the reciprocatable differential piston in its down position.
Figure 15:
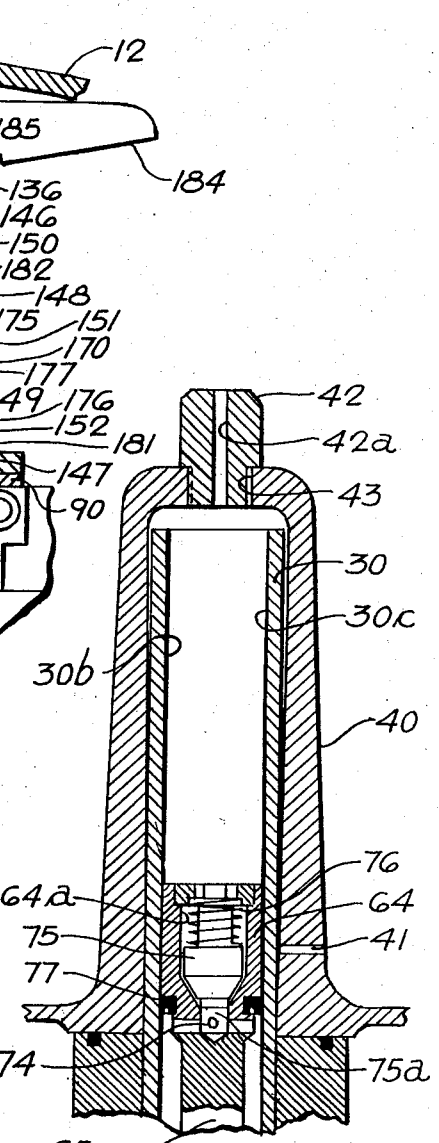
FIG. 15 is an enlarged fragmentary vertical sectional view showing the valve means at the upper, small diameter piston of the differential piston in an open position.

A valve sleeve 50 is reciprocatingly mounted on the bottom portion 30*a* of the cylinder member 30, and O-rings 51—51 form seals therebetween. The valve sleeve 50 is provided with an annular piston shoulder 50*a* which is subjected to air under pressure in the cavity 15 of the hollow housing 11. The valve sleeve 50 may be formed of any suitable material but preferably is molded from a lightweight, high impact strength synthetic plastic material. The valve sleeve 50, as shown, has an annular slot or recess 50*b* which receives a downwardly facing valve ring 55 advantageously formed of a resilient rubber or rubber-like material. A vent passage 56 communicates with the annular slot 50*b* of the valve sleeve 50 so that when the valve ring 55 is forced into the annular slot 50*b*, air trapped in annular slot 50*b* will be vented to atmosphere. Thus, the valve ring 55 may be completely inserted in the annular slot 50*b* without trapping any air therein. After the valve ring 55 is so inserted in the annular groove 50*b*, a plug 58 is inserted in the vent passage 56 so as to close same. As a result, the valve ring 55, in addition to being held in place by friction, is also held in place in the annular slot 50*b* by vacuum. The upper end of the valve sleeve 50 is provided with slots 60 which operate to throttle the supply of air under pressure to the internal cylinder 30*c* of the cylinder member 30 as the valve sleeve 50 is raised from the position shown in FIG. 10 to the position shown in FIG. 9.

The differential piston unit, designated generally by reference numeral 62 has a lower, large diameter piston 63 arranged within the internal cylinder 18 of the cylinder sleeve 17, and an upper, small diameter piston 64 arranged in the cylinder 30*c* of the cylinder member 30. A piston rod 65 connects the pistons 63 and 64 together. The lower, large diameter piston 63 advantageously is formed from metal, such as steel, or the like, and is provided with a packing 66 which is preferably cup-shaped and desirably is molded from a resilient rubber, or a resilient synthetic rubber-like or plastic material. The packing 66 is snapped into a groove in the piston 63 for holding the same in place on the piston 63. In the embodiment of the nailing machine illustrated, the piston 63 has a nail driving blade holder 67 secured as by rivets 68—68 to the base thereof. The holder 67 has a downwardly extending neck portion 67*a* provided with a slot for receiving an end of a nail driving blade 70. The neck portion 67*a* is provided with a transverse bore therethrough for receiving a pin 72 for securing the end of the blade 70 on the holder 67.

The lower end of the piston rod 65 is threaded, and is engaged in a tapped bore 63*a* formed in an upwardly extending neck portion 63*b* of the lower, large diameter piston 63. The upper end of the piston rod 65 is secured as by a pin 74 to a slotted extension 75*a* of a valve 75 carried in a chamber 64*a* formed in the upper, small diameter piston 64. A compression spring 76 resiliently urges the valve 75 into engagement with its conical seat 64*b*. The piston 64 is provided with a packing 77 which is held in place in an annular groove formed in the lower end of the piston 64.

A gland 80, provided at the upper end of the valve disc 35, carries O-rings 81 and 82 which engage the piston rod 65 and seal it and, hence, the internal cylinder 30*c* of the cylinder member 30.

A foot plate 90, having a central opening 90 therethrough, is secured to the bottom of the hollow housing 11 below the cylinder sleeve 17, and, hence, below the differential piston 62. The foot plate 90 carries an annular, resilient rubber or rubber-like bumper 92 having a centrally located opening 92*a* formed therethrough through which the nail driving blade 70 extends. The opening 92*a*, together with the openings 24 of the stationary portion 17*b* of the cylinder sleeve 17 provide air passages for venting air from beneath the lower, large diameter piston 63 to atmosphere both through the slots 11*a* at the base of the hollow housing 11 and through the opening 90*a* of the foot 90. Thus, as the differential piston 62 is reciprocated, air is directed around the annular bumper 92 as well as through the opening 92*a* thereof so as to provide maximum cooling of the bumper 90 to dissipate heat therefrom which is generated by the lower, large diameter piston 63 engaging the bumper 92 as the nail driving blade 70 is advanced.

Joined as by bolts 93 to the foot plate 90 and the hollow housing 11 is a foot 95. The foot 95 has a pair of spaced, downwardly extending side flanges 96—96 which are joined along their rear margins to a slotted rear wall portion 97 to which is secured as by bolts 98, nail guide and positioning means designated generally by reference number 100. The nail guide and positioning means 100 comprises a stationary front plate 101 and a cooperating movable back plate 102. As best illustrated in FIGS. 19 through 27, the stationary front plate 101 is recessed at 101*a* to receive the movable back plate 102. The front plate 101 also has a central recess 101*b* which is configured to accommodate the guide margins and one of the raised central areas 70*a* provided on the sides of the nail driving blade 70. A series of vertically spaced bores 101*c* are provided along each margin of the front plate 101 for receiving the screws 98. The front plate 101 is also provided with a pair of tapped bores 101*d* positioned in aligned relation to one another in the recess 101*a* of the front plate 101. The bores 101*d* each receive a knurled headed screw 104.

The movable back plate 102 of the nail guide and positioning means 100 is provided with an elongated gate or slot 102*a* which functions as a gate for sequentially admitting and positioning nails from a nailing strip 105. On the inner wall of the back plate 102, at the extremities of the slot 102*a*, a channel or recess 102*b* is provided. The recesses 101*b* and 102*b* cooperate to provide a guideway for the nail driving blade 70. In order to assure positive positioning and alignment of a nail with the driving blade 70 and a workpiece prior to and during a nail severing and driving sequence, the lower margin 102*c* of the slot 102*a*, on each side of of the recess 102*b* is chamfered or beveled. The beveled lower margin 102*c* enables the movable back plate 102 to unerringly intercept the pointed shanks of a nail fed through the slot 102*a* of the back plate 102. The back plate 102, as shown, has a pair of vertically extending, elongated slots 102*d*—102*d* formed therein on opposite sides of the recess 102*b*. The slots 102*d*—102*d* receive the threaded ends of the knurled headed screws 104. The extremities of the slots 102*d*—102*d* define the limits of the longitudinal movement of the back plate 102 with relation to the front plate 101. The back plate 102 also is provided with a valve activating extension 102*e*, the function of which will become clear as the description proceeds.

Figures 25, 26, 27, 28, 29, 30, 31:
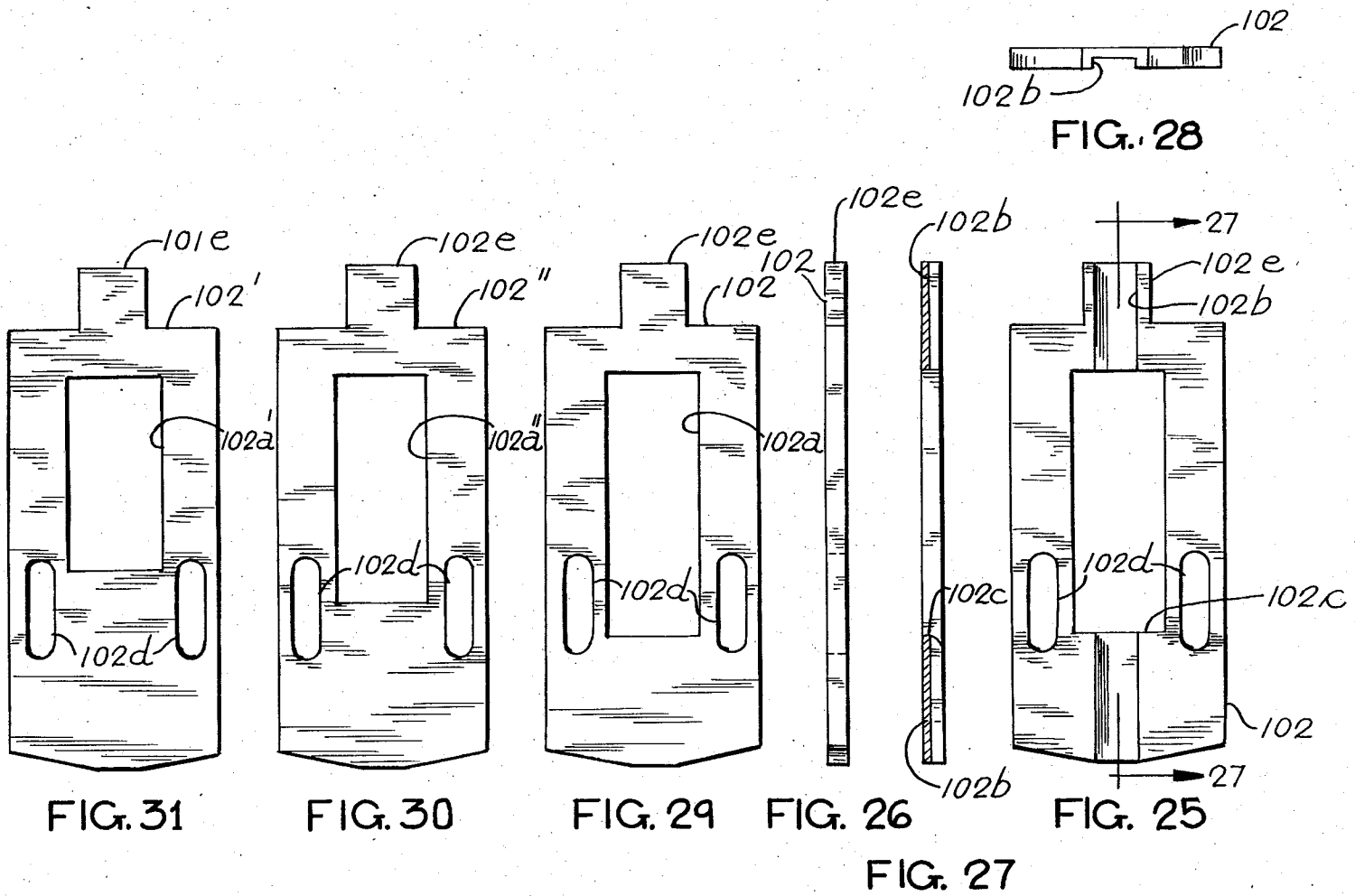
FIG. 25 is a front view in elevation of an embodiment of the movable member of the nail guide and positioning means of the nailing machine.
FIG. 26 is a side view in elevation of the movable member shown in FIG. 25.
FIG. 27 is a vertical sectional view of said movable member taken substantially along line 27—27 of FIG. 25.
FIG. 28 is a top plan view of the member shown in FIG. 25.
FIG. 29 is a rear view in elevation of the embodiment of the movable member shown in FIG. 25.
FIGS. 30 and 31 are rear views in elevation of embodiments of movable members of the nail guide and positioning means each of which define a different size opening or gate for receiving a nail of a preselected length.

As stated hereinabove, the nailing machine of the present invention can be used with nails of different length. Nails used in nailing machines range in size from an inch to one and a quarter inches to one and a half inches. In accordance with a preferred embodiment of the present invention, the nailing machine 10 includes a plurality of movable back plates such as the plate 102. Thus, as illustrated in FIGS. 29 through 30, the movable back plates 102' and 102" are adapted to accommodate nails of one inch and one and a quarter inches, respectively, in length. The plate 102 is adapted to accommodate nails one and half inches in length. The plates 102, 102' and 102" differ from one another only in the length of the slots 102*a*, 102'*a* and 102"*a*. Interchanging of the movable plates 102, 102' and 102" is easily and readily accomplished by simply turning the knurled headed screws 104 until the movable plate can be disengaged from the front plate 101, and then replacing it with a movable plate capable of accommodating the length of the nails desired to be used on a particular job. The frequency of such changes is usually minimal since the same length nail is generally used throughout the day to complete a job.

The foot 95 also provides support for the nail feeder mechanism of the embodiment of the nailing machine 10 shown in the drawings. The mechanism, designated generally by reference numeral 110 in FIG. 1, is secured, as by screws 111, to a bracket 112 having outwardly extending front flanges 112*a* and outwardly extending top flanges 112*b*. The flanges 112*a* are secured to the slotted rear wall portion 97 of the foot 95 by bolts 98, while the flanges 112*a* are secured to the foot 95 by screws 113. The mechanism as best shown in FIGS. 1 through 6, comprises an elongated support member 115 desirably fabricated of a lightweight metal such as aluminum or an aluminum alloy. The member 115, as illustrated, has a generally inverted-T configuration, and includes a base portion 115*a* and a centrally positioned upwardly extending rail portion 115*b*. The base portion 115*a* of the member 115, at its forward end, is secured to the bracket 112 by the screws 111. A generally U-shaped elongated nail guide member 116 is secured as by screws 117, to the base portion 115*a* of the member 115 rearwardly of its point of connection to the bracket 112. A similarly shaped, elongated nail guide track 120 is secured, as by rivets 121, in overlying relation on the top of the rail portion 115*b* of the support member 115. As best shown in FIG. 1 of the drawing, a pair of screws 122—122 desirably are positioned on the upper surface of the base portion 115*a* forwardly of the midpoint of the member 115. The screws 122—122 serve to anchor one end of a pair of elongated compression springs 125—125 each of which is looped over a pair of pulleys or rollers 126—126 secured to the sides of the bracket 112, as by screws 127—127, on opposite sides of the rail portion 115*b* of the member 115. The other end of the springs 125—125 is attached to the rear or trailing end of a nail feeder or pusher member 130.

The pusher member 130, as shown, in generally U-shaped, and is slidably carried on the nail guide track 120. The sidewalls 130*a*—130*a* of the member 130 have inwardly extending edges 130*b*—130*b* which engage the lower edges of the U-shaped guide track 120 thereby preventing the member 130 from being disengaged from the guide track 120 by the force exerted by the springs 125—125 on the pusher member 130 while at the same time enabling the member 130 to freely slide in either direction on the guide track 120. An upwardly extending stop 131 is provided inwardly of the rear or tail end of the guide track 120 to limit the rearward movement of the pusher member 130.

The leading or ram end 130*c* of the pusher member 130, as shown, is formed as an extension of the sidewalls of the member 130. The ram 130*c* has a pair of upwardly extending nail-head engaging portions 130*d*—130*d* which are formed with a shoulder 130*e* for engaging a small area of the top of the last nail 105*a* of the nailing strip 105. The substantially straight, vertical nail contacting edges 130*d*—130*d* of the ram 130*c* are adapted to engage the head and the upper portion of the shank of the last nail 105*a* comprising the strip 105. This arrangement acts to exert the force transmitted by the springs 125—125 on the pusher member 130 in a manner to always positively urge the nailing strip in a straight, properly aligned path along the guide track 120 and through the slot or gate formed in rear wall portion 97 of the foot 95 where each nail is sequentially engaged by the nail guide and positioning means 100. This effect is maintained until every nail, including the last nail 105*a*, has been used. The ability of the ram end 130*c* of the pusher member 130 to keep the nailing strip 105, and each nail comprising the strip, moving in a straight path and in alignment with the gate formed by the slot in the wall portion 97 of the foot 95 and the slot 102*a* of the plate 102 eliminates misalignment of a nail with relation to a workpiece while being driven by the blade 70. Thus, not only does the nailing operation proceed without interruption, but, also, there is no wasted effort on the part of the operator and a better work product is obtained. A resilient, nailing strip guide member 132 advantageously is provided to maintain the nailing strip 105 on the guide track 120. As best shown in FIG. 1, one end of the guide member 132 is secured, as by screw 113, to the foot 95, while the free end thereof is curved upwardly and rides along the heads of the nails comprising the nailing strip 105.

The rear end of the pusher member 130 is provided with a pair of spring anchoring extensions 130*f*—130*f* and a pair of ears or extensions 100*g*—100*g* having bores 130*b*—130*b* for attaching a thong or pullcord (not shown) to facilitate movement of the pusher member 130 to a fully retracted position on the guide track 120 while a new nailing strip is being inserted on the guide track 120. In order to maintain the pusher member 130 in its fully retracted position during reloading, a detent 133 advantgeously is provided on the guide track 120 for engaging a bore in the upper wall of the member 130.

Referring, now, in particular, to FIGS. 9 through 14 of the drawings, the nailing machine 10 of the present invention, like the machine disclosed in U.S. Pat. No. 3,601,300, is provided with a boss 136 on the hollow housing 11 for receiving a control valve assembly. The control valve assembly of the present invention corresponds in all respects to the control valve assembly of said patent, and, wherever appropriate like reference numerals have been used to designate like parts. The boss 136 has a cylindrical chamber 137, and is provided with a drilled passage 138 (See FIGS. 11 and 12) extending from the cavity 15 of the hollow housing 11, and which is closed at its lower end by a plug 138*a*. Another drilled passage 139 communicating with the passage 138 enters into the cylindrical chamber 137, the other end of the passage being closed by a plug 139*a*. The passages 138, 139 supply air under pressure into the cylindrical chamber 137 from the cavity 15 of the hollow housing 11. The boss 136 also has a vertical drilled passage 141 extending from the cavity 16 in the housing member 11 below the piston flange 21 of the cylinder sleeve 17, this passage 141 being closed at its bottom end by a plug 141*a*. A drilled passage 142 connects the passage 141 to the interior of the cylindrical chamber 137 at a point below the point where the passage 139 communicates with the cylindrical chamber 137. Thus, the passages 141, 142 connect the cavity 16 of the hollow housing 11 below the piston flange 21 of the cylinder sleeve 17 with the cylindrical chamber 137.

Figure 14:
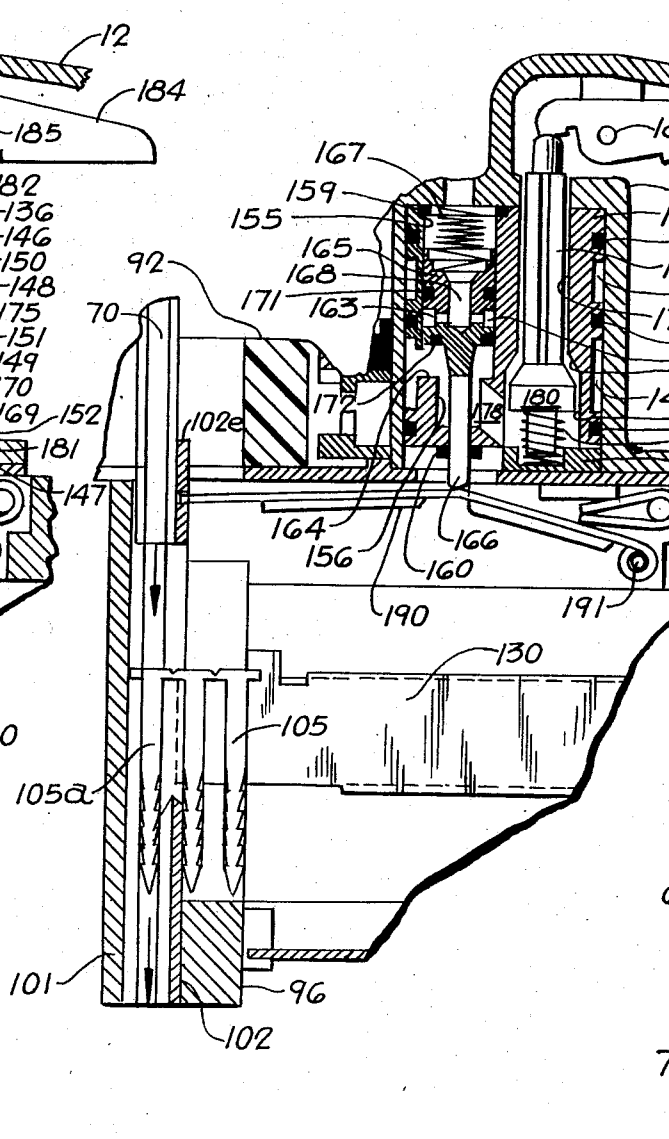
FIG. 14 is a sectional view corresponding to the view of FIG. 13 but showing the valves thereof in their second, open positions.
Figure 13:
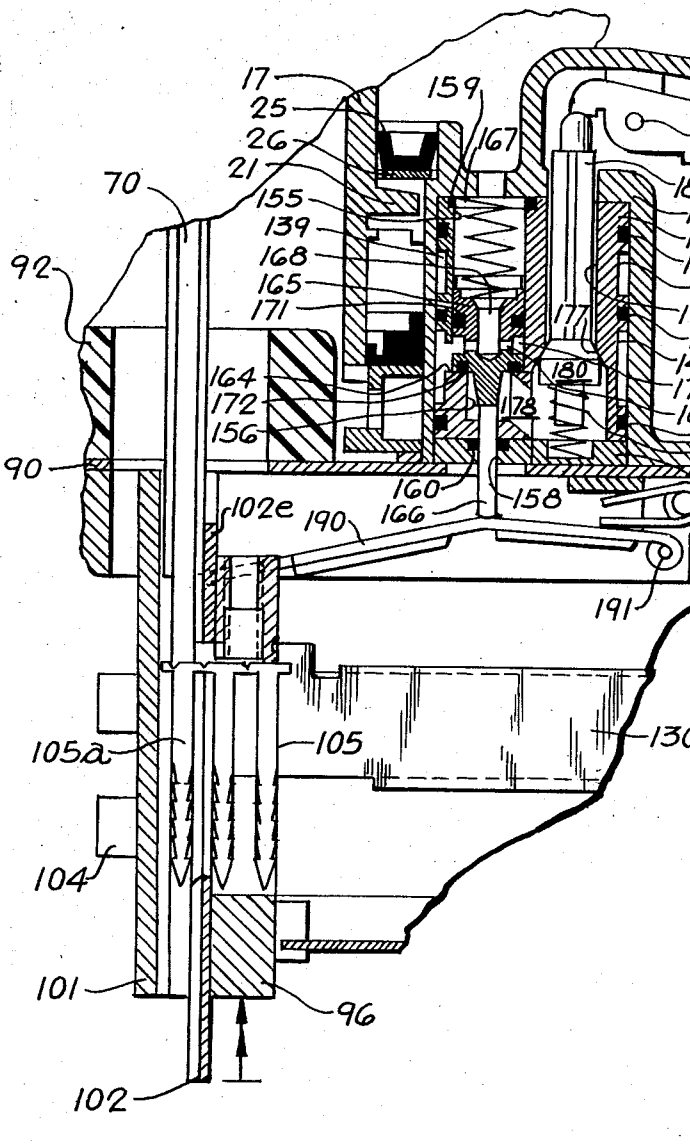
FIG. 13 is an enlarged sectional view through the valve control means illustrating the valves thereof in their normal, closed positions.

A control valve assembly, as shown more clearly in FIGS. 13 and 14, is arranged with the cylindrical chamber 137, it including a valve housing 146 having a closure disc 147 secured thereto by screws or the like, not shown. The valve housing 146 and closure disc 147 may be formed of any suitable material but preferably they are molded from a suitable rigid synthetic plastic material. The control valve housing is provided with an external annular groove 148 which communicates with the passages 138 and 139 leading from the cavity 15 in the hollow housing 11 so that air under pressure is supplied to this annular groove 148. The exterior of the valve housing 146 is also provided with an annular groove 149 which communicates with the passage 141 and 142 so that this annular groove 149 is in communication with the lower cylindrical cavity 16 in the hollow housing 11. These annular grooves 148 and 149 are sealed in the cylindrical chamber 137 by O-rings 150, 151 and 152.

The control valve housing 146 is provided with a first bore therethrough including an upper large diameter bore 154, an intermediate diameter bore 155 and a lower, smaller diameter bore 156. Holes 157 and 158 in the control valve housing 146 and the closure disc 147 communicate with the lower smaller bore 156. The upper bore 154 is sealed with respect to the cylindrical chamber 137 by an O-ring 159 and the holes 157 and 158 are sealed by an O-ring 160. A hole 162 communicates the upper large diameter bore 154 with the annular groove 148 and a hole 163 communicates the intermediate diameter bore 155 with the annular groove 149. A shoulder 164 forming a valve seat is arranged between the intermediate diameter bore 155 and the smaller diameter bore 156.

Arranged within the intermediate diameter bore 155 of the valve housing 146 is a valve 165 which has a valve stem 166 extending downwardly through the small diameter bore 156, the holes 157 and 158 and a hole in the foot plate 90 to a point below the foot plate 90 so as to be engageable by the pivoted lever 132. The O-ring 160 which seals the holes 157 and 158 also seals the valve stem 166. A compression spring 167 within the large diameter bore 154 resiliently urges the valve 165 downwardly. The valve 165 is provided with a central bore 168 which is connected by a plurality of radial passages 169 to an annular groove 170 in the exterior of the valve 165. This annular groove 170 is in communication with the passage 163 in the valve housing 146 when the valve 165 is in its normal down position as illustrated in FIG. 13. An O-ring 171 seals the valve 169 in the intermediate bore 155 between the passage 162 and 163. The bottom annular portion of the valve 169 is provided with an O-ring 172 which is held in place by friction and suction in an annular groove in the valve and which seats against the annular shoulder 164 when the valve is in its normal lowered position as illustrated in FIG. 13.

The valve housing 146 is also provided with a second bore therethrough, the second bore including an upper small diameter bore 175, a lower, large diameter bore 176 and an intermediate conical portion 177. A passage 178 connects the lower, small diameter bore 156 of the first bore to the lower large diameter bore 176 of the second bore. A second valve 180 is located in the lower large diameter bore 176 and it has a conical surface adapted to engage the conical seat 177 between the bores 175 and 176. A compression spring 181 resiliently urges the valve 180 into engagement with its conical seat 177. A fluted stem 182 extends upwardly through the small diameter bore 175 and a hole in the boss 136. A trigger 184 is pivoted at 185 to the handle portion 12 of the nailing machine and is operable to move the valve 180 downwardly against the action of the spring 181 when it is depressed, as illustrated in FIG. 14. The valve 165 and its downwardly depending stem 166 and the upwardly extending fluted stem 182 are preferably molded from a suitable rigid synthetic plastic material, while the valve 180 is preferably molded from a suitable resilient synthetic rubber or rubber like plastic material, such as, for example, buna rubber or the like.

When the valve 169 is in its normal bottom position, as illustrated in FIG. 13, air under pressure from the cavity 15 in the housing 11 is delivered through the passages 138, 139, annular groove 137, passages 162, 168 and 169, annular groove 170, passage 163, annular groove 149 and passages 142 and 141 to the cavity 16 in the housing 11 below the piston flange 21 on the cylinder sleeve 17. As a result, the cylindrical sleeve 17 is in its raised position as illustrated in FIGS. 8 and 9 and the differential piston unit 62 is also in its raised position. In this latter connection the annular upwardly facing valve seat 19 is engaging the valve ring 55 and the valve ring 55 is disengaged from the stationary upwardly facing valve seat 36. With these valve means in these positions as illustrated in FIGS. 8 and 9, the supply of air pressure in the upper cavity 15 of the housing 11 is sealed from above the lower, large diameter piston 63 by the annular valve seat 19 engaging the valve ring 55. Air under pressure from the cavity 15 of the housing 11 is transmitted below the upper, small diameter piston 64 through slots 60 in the valve sleeve 50, annular groove 33 and passage 34 into the cylinder 30*c* of the upper cylinder member 30. Thus, the differential piston is held in its raised position as illustrated in FIGS. 8 and 9.

When the movable member 102 of the nail guide and positioning means 100 of the nailing machine of the present invention is placed against an object to be nailed, the valve activating extension 102*e* of the member 102 pivots a lever 190 upwardly about its pivot 191 as illustrated in FIGS. 13 and 14. This pivoting of the lever 190 raises the valve 169 through its valve stem 166 to its second or upper position against the action of the spring 167. When this occurs, the annular groove 170 of the valve 165 is moved upwardly out of registry with the passage 163 so as to interrupt the supply of air under pressure from the cavity 15 of the housing 11 to below the piston flange 21 of the cylinder sleeve 17. The passage 163 and, hence, the cavity 16 below the piston flange 21 of the cylinder sleeve 17 is connected through the intermediate diameter bore 155, small diameter bore 156 and passage 178 to the large diameter bore 176 for the second valve. However, since the second valve 180 is engaging its seat 177 the cavity 16 below the piston flange 21 of the cylinder sleeve 17 is not vented to atmosphere and the cylinder sleeve 17 is not vented to atmosphere and the cylinder sleeve 17, valve sleeve 50 and the differential piston 62 remain in their upper positions as illustrated in FIGS. 8 and 9.

However, when the trigger 184 is depressed, the fluted stem 182 presses the valve 180 downwardly against the action of the spring 181 to connect the large diameter bore 176 past the valve 180 and through the fluted stem 182 to atmosphere. As a result, when the valves 165 and 180 are both in their second positions as illustrated in FIG. 14, the cavity 16 of the housing 11 below the piston flange 21 is vented to atmosphere through passages 141, 142 annular groove 149, passage 163, intermediate diameter bore 155, small diameter bore 156, passage 178, large diameter bore 176, small diameter bore 175 and fluted stem 182. As a result, air under pressure in the cavity 15 of the housing 11 acts upon the piston shoulder 50*a* of the valve sleeve 50 to move the valve sleeve 50 and the cylinder sleeve 17 downwardly for causing the valve ring 55 to engage the upwardly facing annular valve seat 36 to interrupt the venting to atmosphere of the cylinder 18 above the lower, large diameter piston 63 of the differential piston unit 62. Also, when this occurs, air under pressure in the cavity 15 of the housing 11 acts on the piston shoulder 20 of the cylinder sleeve 17 to move it downwardly to the position shown in FIG. 19. When this occurs, air under pressure from the cavity 15 in the housing 11 is supplied over the annular valve seat 19 to the cylinder 18 above the large diameter piston 63 to drive the differential piston unit 62 downwardly against the action of the air under pressure below the upper small diameter piston 64 of the differential piston unit. The downward movement of the diffential piston unit 62 advances the nail blade 70 to drive the nail into the object to be nailed. As the nail blade 70 engages the top of the nail, the valve 75 of the upper, small diameter piston 64 is unseated thereby venting air under pressure below the piston 64 to atmopshere through the openings 42*a* and 41 in the cover 40. Thus, any resistance to the downward movment of the differential piston unit 62 due to air under pressure below the small diameter piston 64 is dissipated, and the full force of the air under pressure above the lower, large diameter piston 63 is applied to the nail on the down, or power stroke of the differential piston 62.

When the movable member 102 is thereafter removed from the workpiece to be nailed and the trigger 184 is released, the first and second valves 165 and 180 are returned by their respective springs 167 and 181 to the pistons shown in FIG. 13, and the differential piston unit 62 is moved to its raised position in the manner previously described above. When the differential piston unit 62 is so raised, another nail is advanced from the magazine 110 through the gates in the foot 95 and the movable member 102 below the nail-driving blade 70 to condition the nailing machine for its next cycle of operation.

Figure 16:
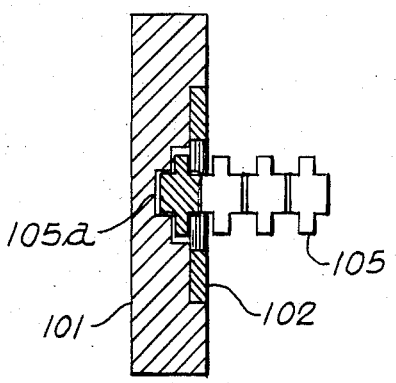
FIG. 16 is a partial horizontal sectional view through the nail guide and positioning means showing the nails of a nailing strip being sequentially advanced therein for severing by the nail driving blade of the machine.
Figure 17:
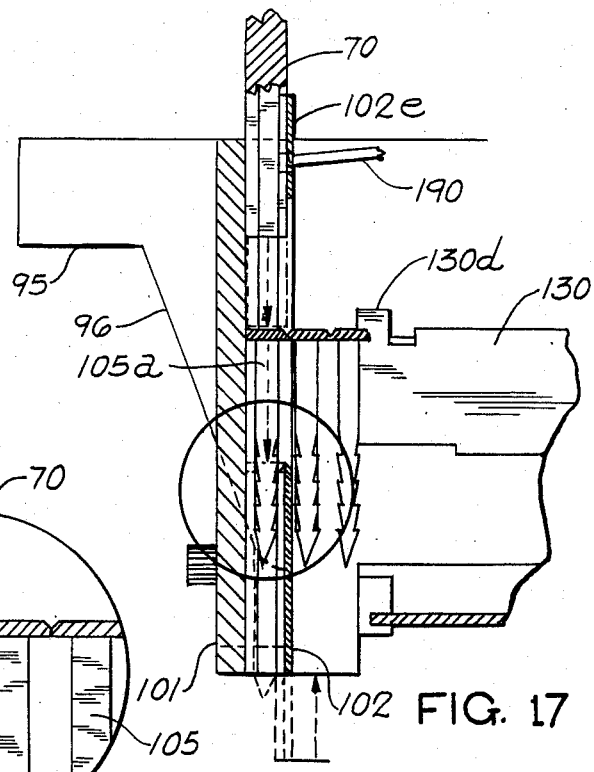
FIG. 17 is a vertical sectional view showing the movable member of the nail guide and positioning means in its nail engaging position just prior to a nail of a nailing strip being severed by the nail driving blade of the machine.
Figure 17A:
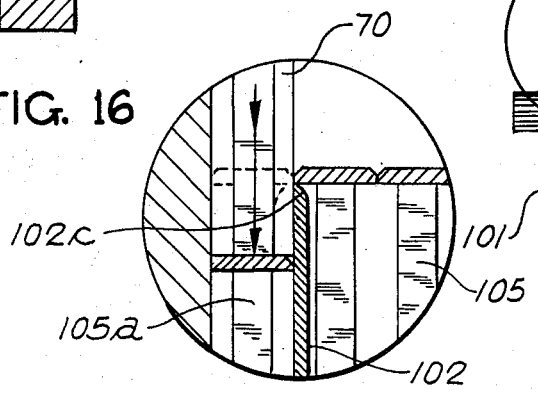
FIG. 17A is is an enlarged view of the circled area of FIG. 17 showing a severed nail moving downwardly along the nail guide and positioning means.
Figure 18:
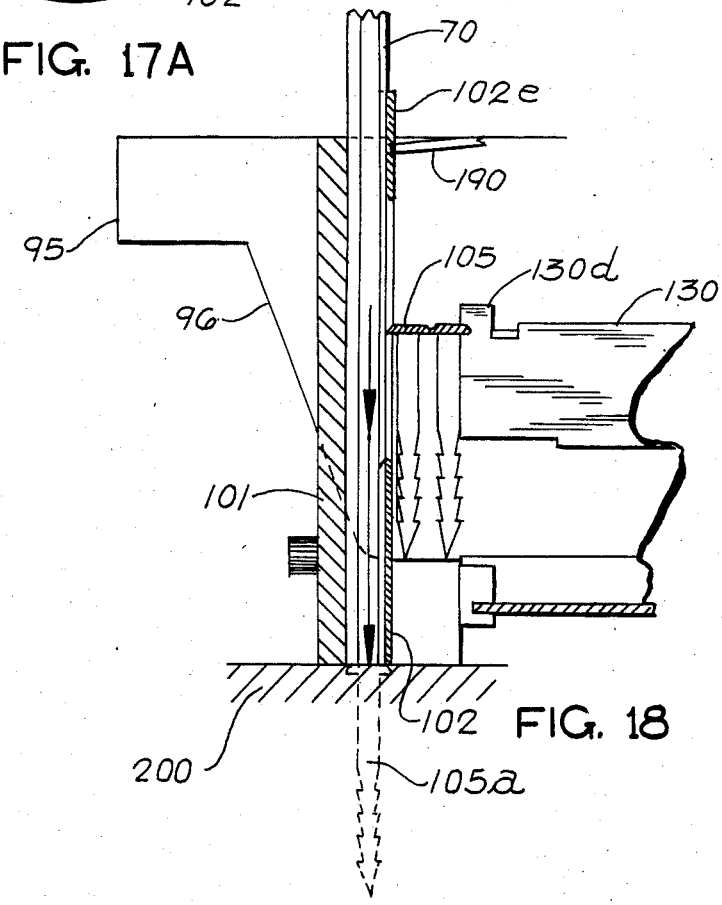
FIG. 18 is a view corresponding to the view of FIG. 17 showing a nail being driven into a workpiece by the nail driving blade of the machine.

Referring, now, in greater detail to FIGS. 16 through 18 of the drawings, when the movable member 102 of the nail guide and positioning means 100 is placed against a workpiece 200, and a nail 105*a* comprising the nailing strip 105 has been advanced through the gate 102*a* of the member 102, the movable member 102 moves upwardly a distance approximately equal to the length of the slots 102*d*. As the member 102 moves, the beveled lower edge 102*c* of the gate 102*a* contacts, and rides along the shanks 105*b* of the nail 105*a* positioned below the blade 70 in the nail guide and positioning means 100. The holding action thusly exerted by the movable member 102, coupled with the force applied by the ram 130*c* of the pusher 130 on the nail head and the shanks of the last nail comprising the nailing strip 105, maintain each nail in a properly aligned position both with relation to the nail driving blade 70 and the workpiece, thereby enabling the nails to be positively and unerringly driven into the workpiece. At the same time that the movable member 102 is engaging a nail of the nailing strip 105, the valve activating extension 102*e* is pivoting the lever 190 to unseat the valve 169 through its valve stem 166.

While for purposes of illustration, one preferred form of this invention has been disclosed, other forms of this invention may become apparent to those skilled in the art and, therefore, this invention is to be limited only by the scope of the appended claims.

What is claimed is:

1. A pneumatically operated nailing machine comprising: a reciprocatable blade for driving nails when advanced; a reciprocatable differential piston for advancing and retracting the reciprocatable blade, said reciprocatable differential piston having a lower, large diameter piston and an upper, small diameter piston; a piston rod for said reciprocatable differential piston; a reciprocatable cylinder sleeve having a cylinder for receiving the lower, large diameter piston; a cylinder member having a cylinder for receiving the upper, small diameter piston; passages for conveying air under pressure beneath the upper, small diameter piston and for venting to atmosphere air above the lower, large diameter piston to drive the reciprocatable differential piston upwardly and to retract the reciprocatable blade, and for interrupting the venting of air to atmosphere from above the lower, large diameter piston, and for supplying air under pressure above the lower, large diameter piston to drive the reciprocatable differential piston downwardly to advance the reciprocatable blade; control valve means for selectively supplying air under pressure to said passages; and valve means for the upper, small diameter piston for venting air under pressure below the upper, small diameter piston to atmosphere when the reciprocatable blade is advanced by the reciprocatable differential piston.

2. A nailing machine according to claim 1 wherein the valve means for the upper, small diameter piston is positioned in a chamber formed in the upper, small diameter piston, said valve means including a valve, and spring means for maintaining the valve in a seated condition when the reciprocatable differential piston is in a retracted position.

3. A nailing machine according to claim 2 wherein the valve of said valve means is provided with an extension to which the upper end of the piston rod of the reciprocatable differential piston is attached.

4. A nailing machine according to claim 3 wherein the upper end of the rod is attached to said extension by a pin.

5. A nailing machine according to claim 1 wherein the lower, large diameter piston is provided with a blade holder, said holder having a slot formed therein for receiving the upper end of the blade, and pin means for securing said end of the blade on the blade holder.

6. A pneumatically operated nailing machine comprising: a reciprocatable blade for driving nails when advanced; a reciprocatable differential piston for advancing and retracting the reciprocatable blade, the reciprocatable differential piston having a lower, large diameter piston and an upper, small diameter piston; a piston rod for the reciprocatable differential piston; a reciprocatable cylinder sleeve having a cylinder for receiving the lower, large diameter piston; a cylinder member having a cylinder for receiving the upper, small diameter piston; passages for conveying air under pressure beneath the upper, small diameter piston and for venting to atmosphere air above the lower, large diameter piston to drive the reciprocatable differential piston upwardly and to retract the reciprocatable blade, and for interrupting the venting of air to atmosphere from above the lower, large diameter piston, and for supplying air under pressure above the lower, large diameter piston to drive the reciprocatable differential piston downwardly to advance the reciprocatable blade; control valve means for selectively supplying air under pressure to said passages; a stationary foot secured to the nailing machine below the reciprocatable cylinder sleeve and the lower, large diameter piston through which the reciprocatable blade extends, said foot having a nail gateway formed therein; nail feeder means secured to the stationary foot, said nail feeder means including a strip of interconnected nails adapted to be sequentially advanced one at a time through the nail gateway of the stationary foot into a position to enable each nail of the strip to be driven into a workpiece by the reciprocatable blade; and nail guide and positioning means for sequentially receiving a single nail from the nail feeder as it is passed through the nail gateway of the stationary foot, said nail guide and positioning means including a stationary outer blade-guide member secured to the stationary foot and a movable inner blade-guide member slidably supported on the stationary outer blade-guide member and being movable between a normally extended nail receiving position and a nail contacting and aligning position for maintaining a nail in proper position with relation to the reciprocatable blade and a workpiece when the reciprocatable blade is advanced, said stationary outer blade-guide member and said movable inner blade-guide member together forming a reciprocatable blade guideway therebetween, said movable inner blade-guide member having a longitudinally extending slot formed therein which is in register with the nail gateway of the stationary foot when the movable inner blade-guide member is in its normally extended positon, said movable inner blade-guide member acting to prevent a second nail from said strip of interconnected nails from passing through the slot formed therein when said movable inner blade-guide member is in its nail contacting and aligning position for maintaining a single nail in position in said reciprocatable blade guideway when the machine is in a nail driving position and a nail is to be driven into a workpiece.

7. A nailing machine according to claim 6 wherein the movable member of the nail guide and positioning means is provided with control valve engaging means for effecting activation of at least one of said control valve means.

8. A nailing machine according to claim 6 wherein the stationary blade-guide member carries releasable fastening means, and the movable blade-guide member is provided with slots into which the releasable fastening means extends, said slots defining the extent of the movement of the movable inner blade-guide member in relation to the stationary outer blade-guide member.

9. A nailing machine according to claim 8 wherein the movable blade-guide member is releasably attached to the stationary outer blade-guide member to enable the movable inner blade-guide member to be interchanged with a different movable inner blade-guide member to permit the nailing machine to be used with nails of different length as desired.

10. A nailing machine according to claim 9 wherein each movable inner blade-guide member to be substituted for another movable inner blade-guide member has a gate formed therein of a size to accommodate a nail of a length which is different from each of the other movable inner blade-guide members.

11. A nailing machine according to claim 10 wherein each movable inner blade-guide member is beveled along the lower margin of its gate to facilitate contact with and proper positioning of a nail to be driven into a workpiece by the reciprocatable blade.

12. A nailing machine according to claim 6 wherein the nail feeder means is secured to a bracket which is attached tothe stationary foot of the nailing machine, said nail feeder means including an elongated nail track for supporting a nailing strip; nail pusher means slidably engaged on said track, said pusher means having a ram portion for contacting the head and a portion only of the shanks of the last nail comprising the nailing strip on said track; spring means for the nail feeder mean, one end of the spring mean being attached to the nail pusher means and the other end thereof being anchored to the nail feeder means and a pair of rollers secured to the bracket for supporting the spring means forwardly of the nail pusher means.

13. A pneumatically operated nailing machine comprising a hollow housing supplied with air under pressure; a reciprocatable blade extending through the bottom of the housing for driving nails when advanced; a reciprocatable differential piston unit in the housing having a lower, large diameter piston and an upper, small diameter piston; valve means for the upper, small diameter piston for releasing any air under pressure below the upper, small diameter when the blade is advanced; a piston rod interconnecting the lower, large diameter piston and the upper small diameter piston; blade holder means for securing the blade to the lower end of the differential piston unit to be advanced and retracted thereby; a cylinder sleeve reciprocatably mounted in the housing and having a cylinder reciprocatingly receiving the lower, large diameter piston of the differential piston unit, said cylinder sleeve having at its upper end an upwardly facing annular valve seat and an annular piston shoulder of small area therearound subject to the air under pressure in the housing and having intermediate its ends an annular piston flange of large area therearound; a cylinder member in the housing having a cylinder reciprocatingly receiving the upper, small diameter piston of the differential piston unit, said cylinder member having sealing means for the piston rod of the differential piston unit for sealing the cylinder for the lower large diameter piston from the cylinder for the upper small diameter piston and having an upwardly facing annular valve seat of smaller diameter than the annular valve seat at the upper end of the cylinder sleeve and located adjacent thereto and radially spaced inwardly therefrom; a valve sleeve reciprocatingly carried by the cylinder member and having a downwardly facing annular valve ring engageable with said upwardly facing annular valve seats of said cylinder sleeve and cylinder member and having an annular piston shoulder subject to the air under pressure in the housing, said cylinder member including passageways for venting to atmosphere the upwardly facing annular valve seat thereof and the cylinder thereof above the upper small diameter piston of the differential piston unit, said housing having passageways for venting to atmosphere the cylinder of the cylinder sleeve below the lower, large diameter piston of the differential piston unit, said cylinder member having passageways for supplying air under pressure from the hollow housing to the cylinder thereof below the upper small diameter piston of the differential piston unit, means including control valve means in one condition for supplying air under pressure from the housing below the annular piston flange of the cylinder sleeve for moving the same upwardly to cause the annular valve seat thereof to engage the annular valve ring of the valve sleeve and to move the valve sleeve upwardly to disengage the annular valve ring thereof from the annular valve seat of the cylinder member for sealing the cylinder of the cylinder sleeve above the lower large diameter piston of the differential piston unit from the air under pressure in the housing and for venting the same to atmosphere, whereby the air under pressure in the cylinder of the cylinder member below the upper small diameter piston of the differential piston unit moves the same upwardly to retract the nail-driving blade, said means including said control valve means also being operative in another condition for venting to atmosphere air from below the annular piston flange of the cylinder sleeve for allowing the air under pressure in the housing acting on the annular piston shoulder of the valve sleeve and the annular piston shoulder of the cylinder sleeve to move the same downwardly, to cause the annular valve ring of the valve sleeve to engage the annular valve seat of the cylinder member and to disengage the annular valve seat of the cylinder sleeve from the annular valve ring of the valve sleeve for sealing the cylinder of the cylinder sleeve above the lower large diameter piston of the differential piston unit from the atmosphere and supplying air under pressure thereto from the housing, whereby the air under pressure in the cylinder of the cylinder sleeve above the large diameter piston of the differential piston unit overcomes the force of the air under pressure in the cylinder of the cylinder member below the small diameter piston of the differential piston unit and moves the same downwardly to advance the nail-driving blade; nail guide and positioning means for contacting and maintaining a nail to be driven by the blade in proper alignment with the blade and a workpiece; support means secured to the hollow housing for carrying the nail guide and positioning means, said support means having a gate for admitting nails sequentially into the nail guide and positioning means; and nail feeder means attached to said support means for sequentially advancing nails through the gate of the support means and into the nail guide and positioning means.

14. A nailing machine according to claim 13 wherein the valve means for the upper, small diameter piston includes a valve having an extension to which an end of the piston rod is attached.

15. A nailing machine according to claim 13 wherein the nail guide and positioning means includes a stationary member and a movable member, the movable member having means for activating the control valve means when the movable member is placed against a workpiece whereby air under pressure from the housing below the annular piston flange of the cylinder sleeve for moving the sleeve upwardly.

16. A nailing machine according to claim 13 wherein the nail feeder means has a ram portion adapted to engage the head and a portion only of the shanks of the last nail of the nailing strip positioned on the feeder means.

* * * * *